US005231266A

United States Patent [19]

Warren

[11] Patent Number: 5,231,266

[45] Date of Patent: Jul. 27, 1993

[54] TOWELETTE WARMER

[76] Inventor: Joan G. Warren, 2718 S. King Rd., San Jose, Calif. 95122

[21] Appl. No.: 816,870

[22] Filed: Jan. 2, 1992

[51] Int. Cl.[5] ..... B65D 83/08

[52] U.S. Cl. ..... 219/521; 219/438; 219/386

[58] Field of Search ..... 219/385, 386, 521, 436, 219/438; 392/394, 403; 84/94.2, 95.2

[56] References Cited

U.S. PATENT DOCUMENTS

| | | | |
|---|---|---|---|
| 1,295,045 | 2/1919 | Lidberg | 219/385 |
| 1,531,136 | 3/1925 | Robinson | 392/403 |
| 2,061,148 | 11/1936 | Fischer | 392/403 |
| 2,800,048 | 7/1957 | Anderson | 84/95.2 |
| 4,193,648 | 3/1980 | Gargiulo | 84/94.2 |
| 4,694,973 | 9/1987 | Rose | 219/385 |
| 4,700,048 | 10/1987 | Levy | 219/386 |
| 4,890,205 | 12/1989 | Sahffer | 219/386 |
| 4,943,705 | 7/1990 | Halloran | 219/385 |
| 5,004,894 | 4/1991 | Whitehead | 219/521 |
| 5,036,178 | 7/1991 | Orbach | 219/385 |

*Primary Examiner*—Teresa J. Walberg
*Attorney, Agent, or Firm*—James J. Leary

[57] ABSTRACT

A towelette warmer for warming and dispensing premoistened, prepackaged disposable towelettes. Alternatively, it may be used to warm non-prepackaged disposable or reusable towelettes. The towelette warmer has a body that contains a watertight vessel and a temperature controlled electric heater. A first lid hinged to the vessel has an aperture through which towelettes are dispensed one at a time. A second lid hinged to the first lid closes the aperture when it is not in use. Other features that may be incorporated into the towelette warmer include a night light, an air freshener, a vaporizer or a music box.

9 Claims, 3 Drawing Sheets

TOWELETTE WARMER

BACKGROUND OF THE INVENTION

This invention relates to an illuminated apparatus for warming and dispensing premoistened, prepackaged disposable towelettes.

In recent years, premoistened, prepackaged disposable towelettes have become readily available for hand washing, makeup removal, baby cleansing and all manner of personal hygiene. These towelettes are typically folded or rolled to fit in a plastic canister that serves as a dispenser and as a reservoir for the cleansing fluid. The towelettes are wetted by capillary action and are dispensed one at a time, either through a small hole in the top of the canister or by opening a reclosable lid to remove a towelette.

In her own experience, the inventor has found that if they are prewarmed to body temperature or slightly above, the towelettes produce a pleasant, soothing sensation when they are applied to the skin. This, she has found, is especially important when the towelettes are used for cleansing babies or elderly people for whom the shock of a cold towelette would be unpleasant and disquieting. In addition, she has found that the cleansing action of the towelettes is improved when they are prewarmed before use.

Accordingly, it is desirable to provide a means for prewarming disposable premoistened towelettes prior to use.

DISCUSSION OF THE PRIOR ART

U.S. Pat. No. 4,694,973 to Rose et al. discloses a device for warming and illuminating prepackaged, prewetted disposable towels. One or more small incandescent light bulbs are provided to serve as the heating element and the means of illumination. No means of temperature control or prevention of overheating are disclosed. Also, no insulative barrier is provided to improve the efficiency of the heater or to maintain the outside of the container at a safe, cool temperature. The device may only be used with prepackaged towelettes.

U.S. Pat. No. 4,890,205 to Shaffer discloses a similar device that uses an incandescent light bulb for warming and illuminating prepackaged, premoistened towelettes. This device has the same drawbacks in that it provides no temperature control, no overheating protection, no insulative barrier and can only be used for prepackaged towelettes.

The Wipe Warmer, available from Sky Mall Merchandizing Service, is a device for warming premoistened, prepackaged towelettes that resembles a small electric blanket that wraps around the towelette dispenser and fastens with velcro. The Wipe Warmer heats the towelettes to a constant 99° F. It does not include any means for illumination, and it may only be used for prepackaged towelettes.

DESCRIPTION OF THE INVENTION

It is the objective of the present invention to provide a device for warming and dispensing premoistened towelettes which is safer, more versatile, and more useful than the devices presented in the prior art. To this end, the present invention incorporates many unique features not heretofore available in a towelette warmer. Other objectives of the invention will be apparent from the ensuing description.

Figure 1:
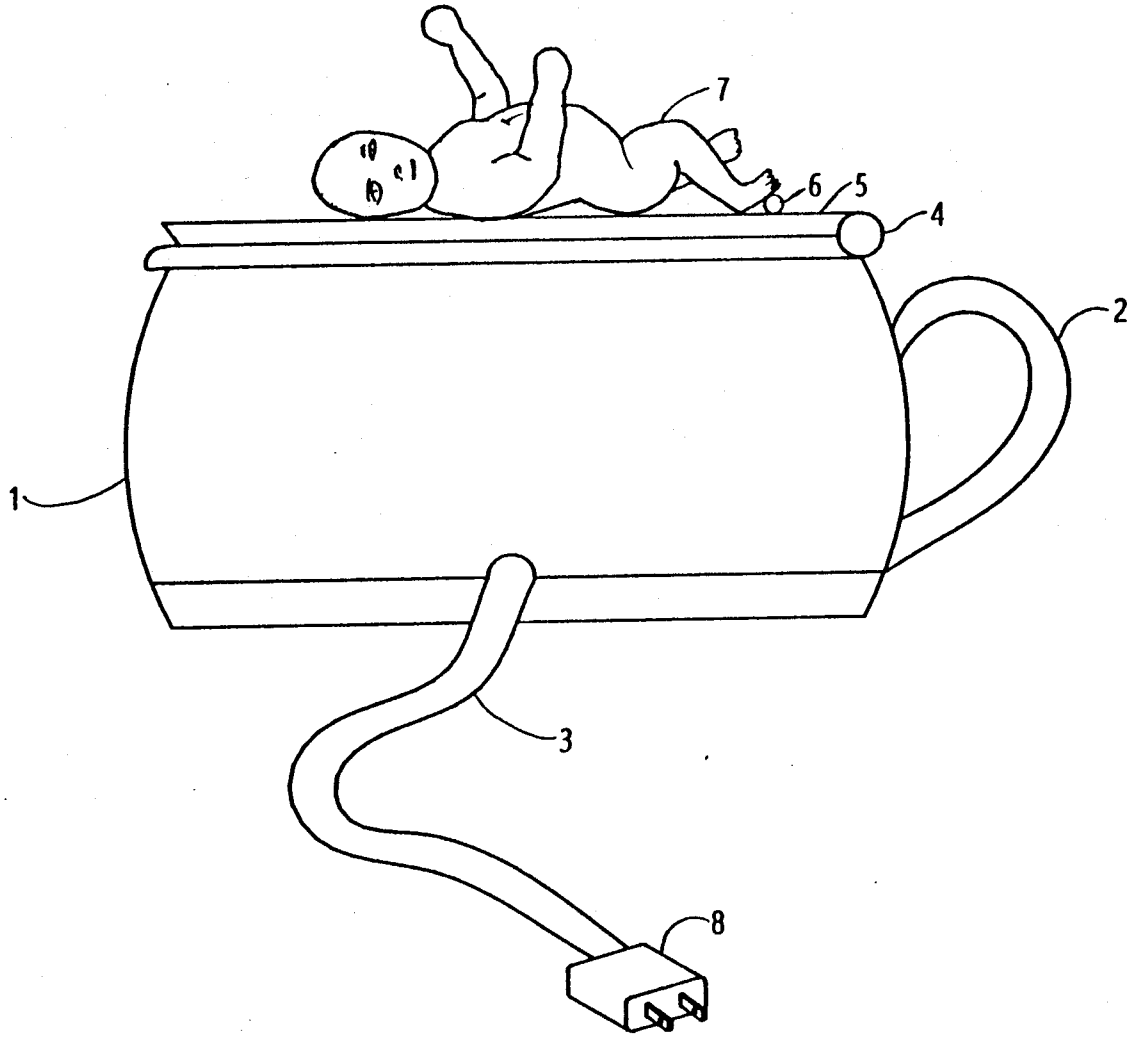
FIG. 1 illustrates the towelette warmer of the present invention.

FIG. 1 shows an external view of the towelette warmer of the present invention. The towelette warmer has a body 1 which is covered by a first lid 5 which may be attached by a hinge 4 to the body 1. The first lid 5 has an aperture (16 in FIG. 2) which is covered by a second lid 7 hinged 6 to the first lid 5, through which towelettes are dispensed one at a time.

Figure 2:
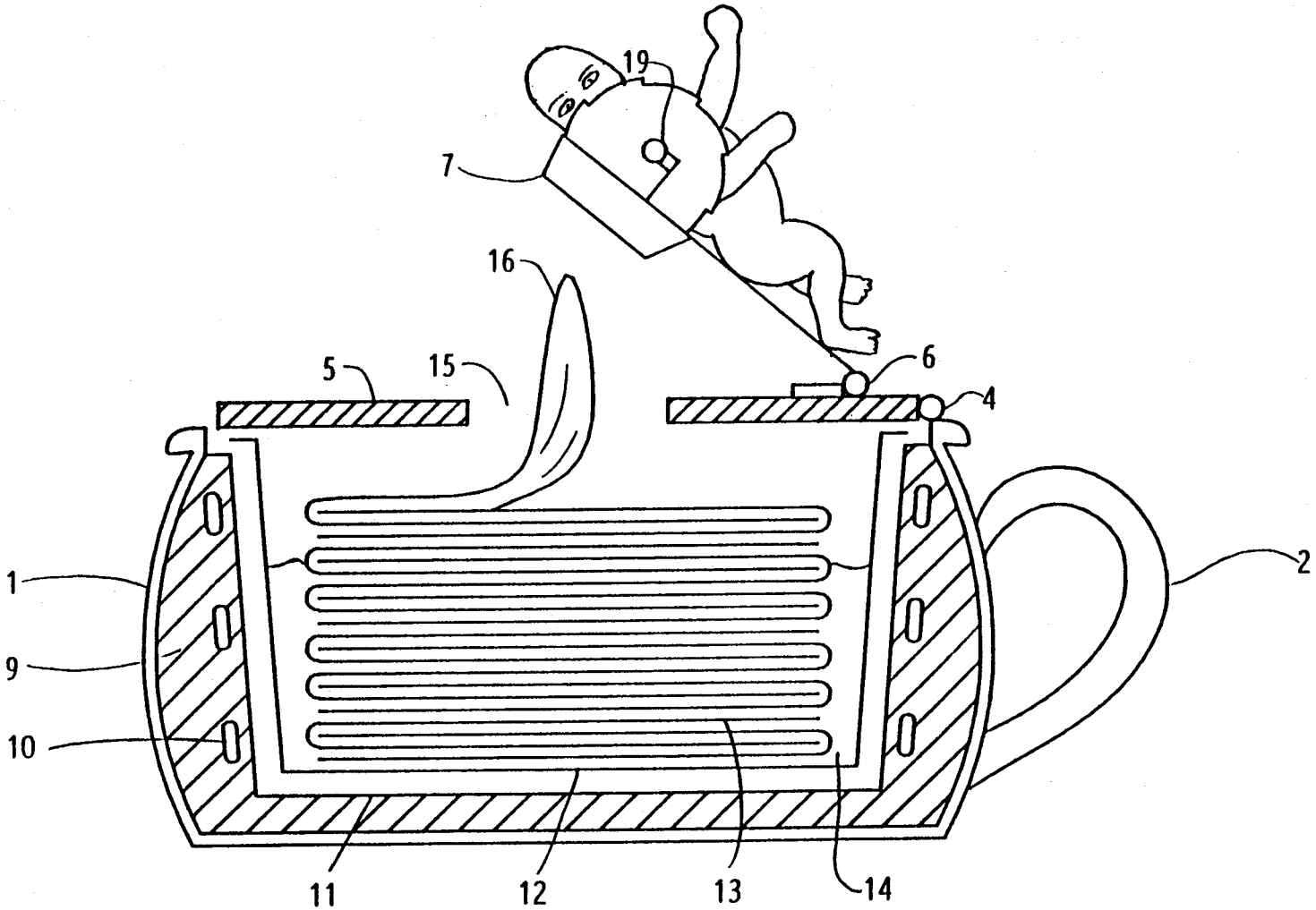
FIG. 2 shows a cross sectional view of the towelette warmer.

The cross sectional view in FIG. 2 shows that, inside the body 1, the towelette warmer has a watertight vessel 11 which is open at the top. The vessel 11 may be made of plastic, metal or ceramic. The vessel 11 is shaped to accept either round or rectangular towelette dispensers 12. The vessel 11 is heated by a temperature controlled resistance heater 10 in the bottom and/or sides of the vessel 11 with a means to connect the heater to an electrical power source. The means for connection to an electrical power source may include a two or three conductor electrical cord 3 and a standard plug 8 for connecting to household current or for connecting to the cigarette lighter of an automobile or another power source.

The temperature control is provided by a thermostat or by using a self limiting constant-temperature heating element 10, as shown. A variable thermostat may be used so that the user may vary the temperature of the towelettes according to personal preference. The temperature controller not only provides a more precise control over the temperature of the towelettes, but also acts as a safety mechanism to prevent overheating of the towelettes or the device itself.

The use of a watertight vessel 11 is an important feature which makes this device more versatile than any of the prior art. The watertight vessel 11 makes it possible to use the towelette warmer with or without the plastic dispenser 12 that comes with prepackaged towelettes 13. The towelettes may be placed directly in the vessel without a plastic container if more economical towelettes may be purchased in bulk. This is particularly important in commercial installations or other areas of high volume use where the extra cost of prepackaged towelettes could be substantial.

The towelettes 13 may be placed in the vessel 11 along with an appropriate quantity of cleansing fluid 14. This is another point of versatility of the present invention because different cleansing solutions 14 may be chosen for different applications. Fragrance or moisturizing lotion or even disinfectants or medications may be added to the cleansing solution when used this way.

If desired, the towelette warmer may even be used to heat reusable cloth towelettes, either dry or with the user's choice of cleansing solutions.

The body 1 of the towelette warmer which surrounds the vessel 11 is designed to be decorative as well as functional. The body 1, which can be made of ceramic, metal, wood or plastic, may be made in a variety of decorative shapes and may also include one or more handles 2. The body 1 preferably incorporates insulative material 9 surrounding the vessel 11 and the heating element 10 to improve the efficiency of the unit and to prevent the outside of the body 1 from warming up to dangerous temperatures.

The vessel 11 is covered with a first lid 5 which serves to hold a dispenser 12 of prepackaged towelettes 13 inside the warmer. Alternatively, the first lid will serve to seal the towelettes 13 and the cleansing fluid 14 inside the vessel if non-prepackaged towelettes are used.

The first lid 5 includes an aperture 15 through which the towelettes 13 are dispensed one at a time 16. A second lid 7 which is hinged 6 to the first lid 5 serves to seal the aperture 15 between uses.

This second lid 7 may be made in a decorative form, shaped like a baby, a clown, a teddy bear, a flower, or any other decorative shape. The second lid 7 may also contain an illumination means 19 such as a small incandescent light bulb or one or more light emitting diodes to act as a night light. The illumination means 19 may be incorporated into the decorative motif of the lid. Light emitting diodes have the advantage that they are very energy efficient and they will not heat up the handle of the lid 7.

Figure 3:
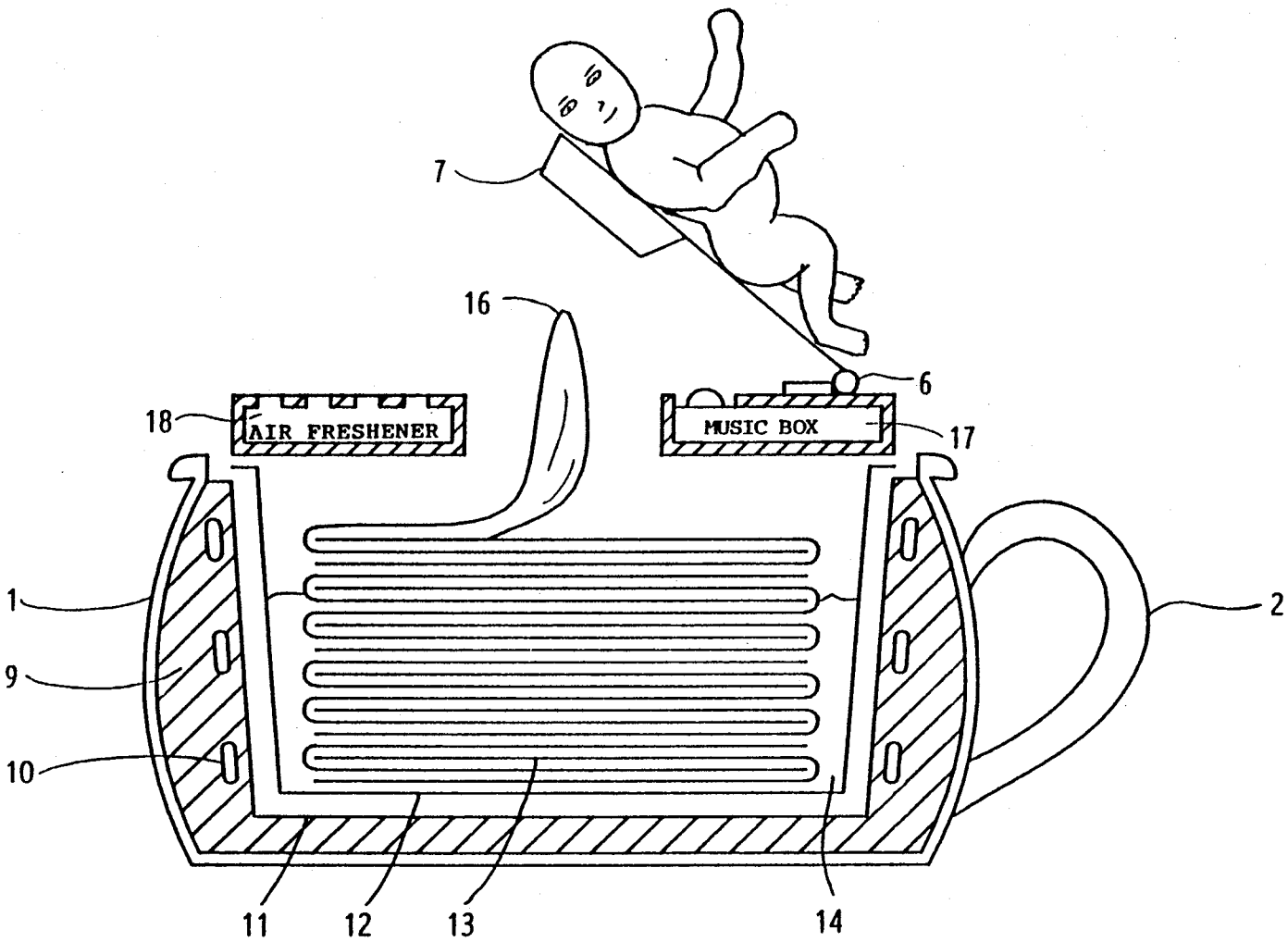
FIG. 3 shows an alternate embodiment of the towelette warmer.

FIG. 3 shows an alternative embodiment incorporating additional features. An electronic or mechanical music box 17 may be mounted within the body 1 or inside the first lid 5 so that a pleasant, soothing melody is played each time the second lid 7 is opened. The music box 17 may shut off when the lid 7 is closed again, or it may be timed to shut off after it completes a melody.

The towelette warmer is suitable for home use in the bathroom, the bedroom, or the nursery or outside the home in an automobile or other vehicle. It is also suitable for public, commercial, or institutional use, such as in public restrooms and baby changing rooms, offices, hotels, airports, locker rooms, hospitals, and nursing homes, wherever a quick freshen-up is desirable. For commercial installations it may be desirable to permanently mount the towelette warmer to the wall or the counter. The towelette warmer may also be provided with a coin operated mechanism for these commercial installations. To increase their commercial appeal, fragrances or moisturizing lotions may be added to the warmed towelettes.

Other features may be added to the towelette warmer which take advantage of its constant temperature. For instance, a heat activated air freshener 18 may be added to the device so that it emanates a pleasant fragrance whenever it is turned on. One useful improvement to this would be to have the air freshener emit a bolus of fragrance each time the second lid 7 is opened. This feature would be especially appreciated when used in the nursery or a baby changing room.

Another feature that would take advantage of the towelette warmer's elevated temperature would be a vaporizer incorporated into the device. This combination would be especially useful when the warmed towelettes are used as a substitute for facial tissues by someone with a cold or flu to avoid the irritation from repeatedly wiping or blowing the nose.

The foregoing description should not be construed as limiting the scope of the invention but merely as illustrative of the presently preferred embodiments. Many variations or other uses for the invention may be made within the scope of the invention. Thus the scope of the invention should be determined by the following claims and not limited by the examples given.

I claim:

1. A towelette warmer comprising, a watertight vessel which is open at the top, said vessel being sized to accept a container of prepackaged, premoistened towelettes, a temperature controlled electric heater in substantial thermal contact with said vessel, a first lid which sealingly engages the top of said vessel, said first lid having an aperture through which said towelettes may be dispensed one at a time, and a second lid which sealingly engages said aperture in said first lid.

2. The towelette warmer of claim 1 wherein said second lid further comprises an illumination means.

3. The towelette warmer of claim 2 wherein said second lid further comprises a handle in the form of a figurine and said illumination means is located within said figurine.

4. The towelette warmer of claim 3 wherein said illumination means comprises a light emitting diode.

5. The towelette warmer of claim 1 further comprising a music box arranged so that said music box plays a melody whenever said second lid is opened.

6. The towelette warmer of claim 1 further comprising an air freshener within said first lid.

7. The towelette warmer of claim 6 wherein said air freshener is activated to release a fragrance by the heat of said electric heater.

8. The towelette warmer of claim 6 wherein said air freshener is adapted to emit a bolus of fragrance when said second lid is opened.

9. A towelette warmer comprising: a watertight vessel which is open at the top, said vessel being sized to accept a container of prepackaged, premoistened towelettes; a temperature controlled electric heater in substantial thermal contact with said vessel; a first lid which sealingly engages the top of said vessel, said first lid having an aperture through which said towelettes may be dispensed one at a time, a second lid which sealingly engages said aperture in said first lid; an illumination means within said second lid; and an air freshener within said towelette warmer adapted to emit a bolus of fragrance when said second lid is opened.

* * * * *